US005918675A

United States Patent [19]

Borak, Jr. et al.

[11] Patent Number: 5,918,675

[45] **Date of Patent: *Jul. 6, 1999**

[54] CLOSE PROXIMITY WELLHEADS

[75] Inventors: Eugene A. Borak, Jr.; Charles D. Bridges, both of Cypress, Tex.

[73] Assignee: ABB Vetco Gray Inc., Houston, Tex.

[ * ] Notice: This patent is subject to a terminal disclaimer.

[21] Appl. No.: 08/927,767

[22] Filed: Sep. 11, 1997

Related U.S. Application Data

[63] Continuation-in-part of application No. 08/759,542, Dec. 5, 1996, Pat. No. 5,810,086.

[51] Int. Cl.[6] ..... E21B 43/01

[52] U.S. Cl. ..... 166/349; 166/313; 166/366; 175/5

[58] Field of Search ..... 166/342, 349, 166/366, 313, 52; 175/5, 7, 9

[56] References Cited

U.S. PATENT DOCUMENTS

| | | | |
|---|---|---|---|
| 4,068,729 | 1/1978 | Peevey | 175/8 |
| 4,136,996 | 1/1979 | Burns | 405/195 |
| 5,330,007 | 7/1994 | Collins et al. | 166/313 |
| 5,458,199 | 10/1995 | Collins et al. | 166/313 |
| 5,560,435 | 10/1996 | Sharp | 175/5 |
| 5,810,086 | 9/1998 | Bridges | 166/313 |

*Primary Examiner*—William Neuder
*Attorney, Agent, or Firm*—James E. Bradley

[57] ABSTRACT

A guidance system comprising two guide tubes is lowered into a well with a conductor. The guide tubes are connected together by partitions which are about 100 feet apart and divide the conductor into two halves. Each partition comprises two symmetrically formed, semi-cylindrical sections facing in opposite directions. A threaded collar is secured to the upper end of each of the guide tubes. The collars are then landed on a lower plate at the upper end of the conductor. An upper plate is secured to the upper end of the conductor on top of the lower plate. The operator lowers a string of drill pipe through holes in the plates into the conductor to drill a first smaller diameter well at the bottom of the conductor. After drilling to the desired depth, the operator runs a first string of casing down the conductor and through the new well bore. The casing is located on one side of each partition and cemented in place. The operator then lowers the drill pipe down the other side of the partitions and repeats the drilling and casing of a second well. After each well is cased, the operator pumps cement down one of the guide tubes to cement the interior of the lower end of the conductor.

19 Claims, 3 Drawing Sheets

CLOSE PROXIMITY WELLHEADS

This application is a continuation-in-part of application Ser. No. 08/759,542, filed Dec. 5, 1996, now U.S. Pat. No. 5,810,086, entitled Single Riser With Two Wellheads.

FIELD OF THE INVENTION

This invention relates generally to drilling wells, and more particularly to an apparatus for drilling two wells in a single conductor.

DESCRIPTION OF THE PRIOR ART

A typical offshore well installation comprises a single conductor in a single well. If necessary, several wells may be located side by side in a template. Multiple wells may also be drilled within a single conductor pipe. However, conductor pipes required for configurations of this nature have a very large diameter and can be relatively expensive. One example of such an installation required a conductor with a diameter the size of a leg in a drilling platform and contained up to 12 wells. That installation utilized a guide member with slots for each well along its periphery and was lowered on a pipe into the conductor. U.S. Pat. No. 5,458,199 shows two wells in a conductor with a guide member at the lower end of the conductor, but an improved guide means is desirable.

SUMMARY OF THE INVENTION

A guidance system comprising two guide tubes is lowered into a well with a conductor. The guide tubes are connected together by partitions which are about 100 feet apart and divide the conductor into two halves. Each partition comprises two symmetrically formed, semi-cylindrical sections facing in opposite directions. A threaded collar is secured to the upper end of each of the guide tubes. The collars are then landed on a lower plate at the upper end of the conductor. An upper plate is secured to the upper end of the conductor on top of the lower plate.

The operator lowers a string of drill pipe into the conductor to drill a first smaller diameter well at the bottom of the conductor. After drilling to the desired depth, the operator runs a first string of casing down the conductor and through the new well bore. The casing is located on one side of each partition and cemented in place. The operator then lowers the drill pipe down the other side of the partitions and repeats the drilling and casing of a second well. After each well is cased, the operator pumps cement down one of the guide tubes to cement the interior of the lower end of the conductor.

DETAILED DESCRIPTION OF THE INVENTION

Figure 1:
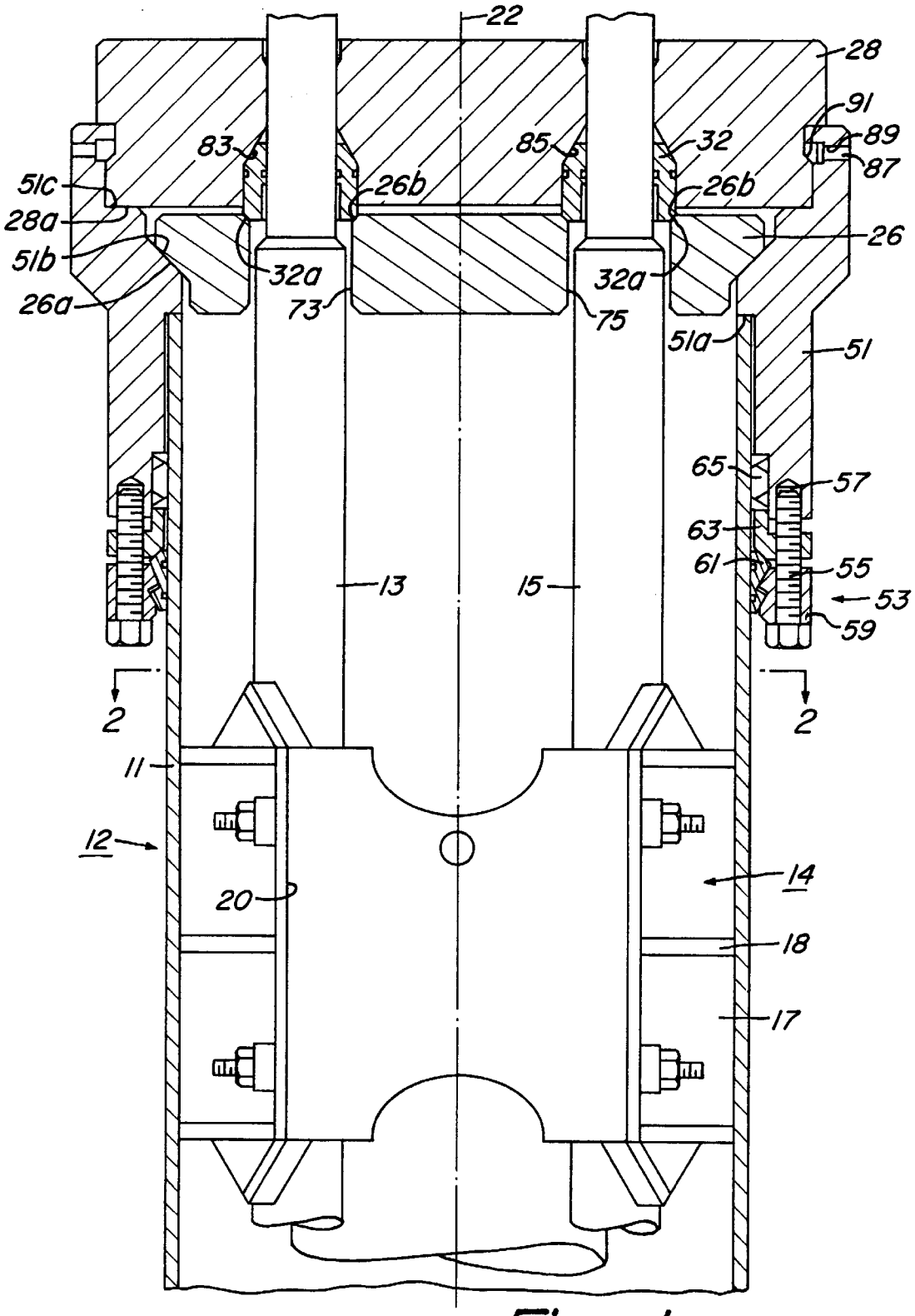
FIG. 1 is a sectional side view of an upper portion of the guidance system shown installed in a conductor pipe and is constructed in accordance with the invention.

Referring to FIG. 1, a large diameter string of conductor 11 with a longitudinal axis 22 is installed in a well 12 to a first depth. Conductor 11 is a steel pipe, typically 36 inches in diameter. Conductor 11 normally extends from a drilling platform at sea level downward to the sea floor and may extend several hundred feet into the earth.

Figure 2:
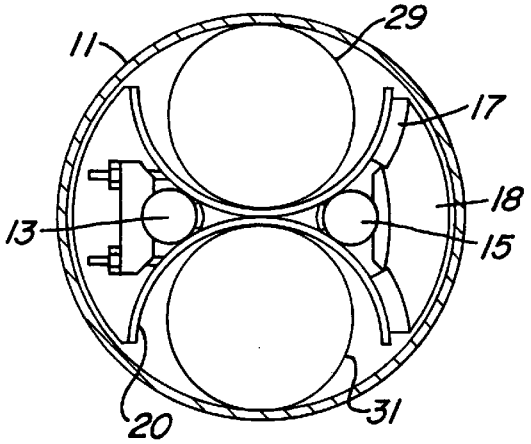
FIG. 2 is sectional top view of a partition of the guidance system of FIG. 1 taken along the line 2—2 of FIG. 1.
Figure 5:
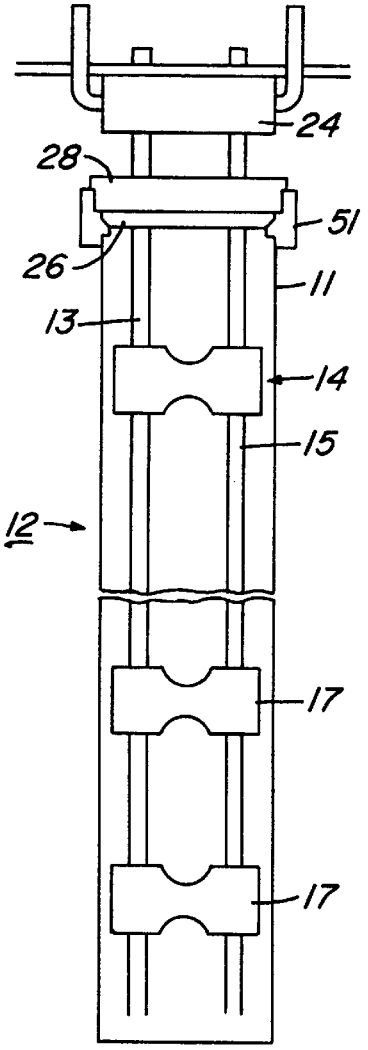
FIG. 5 is a schematic drawing of the guidance system of FIG. 1, shown in a conductor pipe during the initial installation phase.
Figure 6:
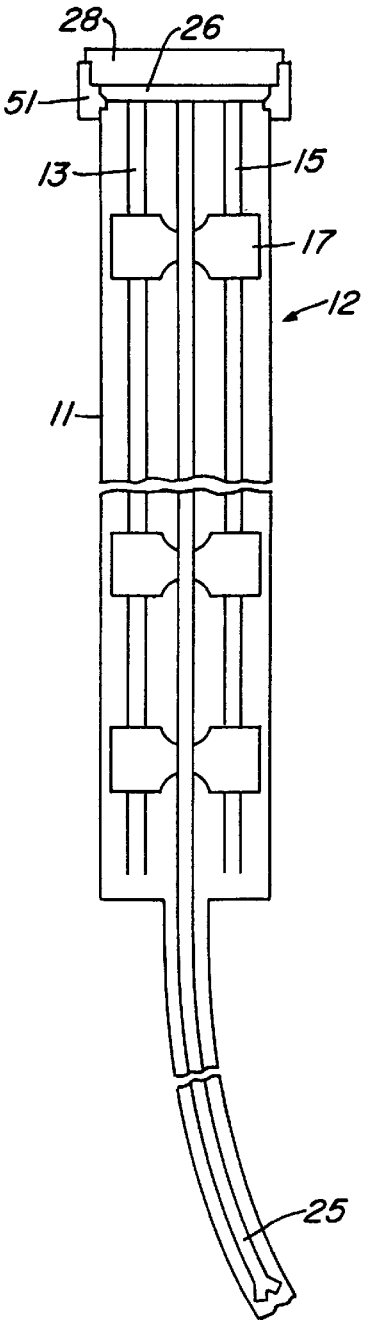
FIG. 6 is a schematic drawing of the guidance system of FIG. 5 showing a first well being drilled.
Figure 7:
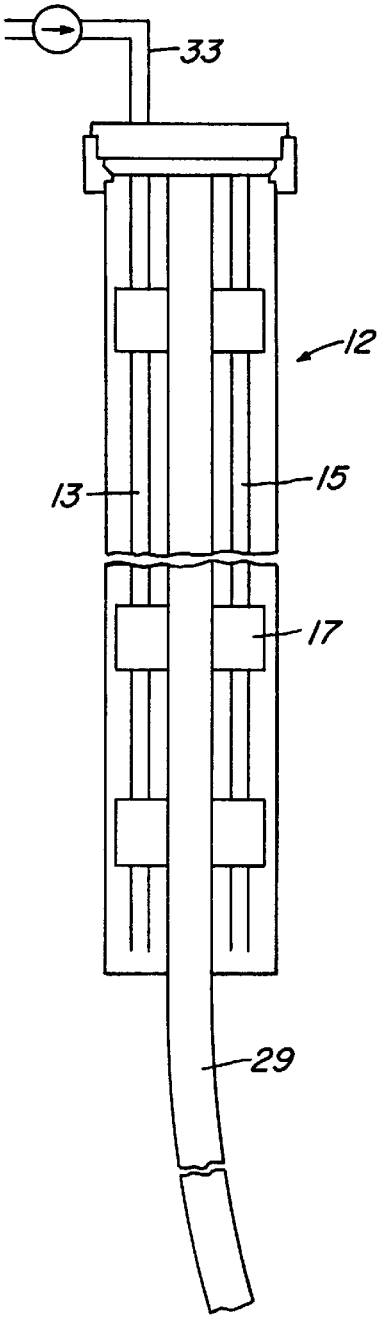
FIG. 7 is a schematic drawing of the guidance system of FIG. 5 showing a first completed well.

A guidance system 14 comprising two guide tubes 13, 15 is lowered into conductor 11. In the preferred embodiment, guide tubes 13, 15 consist of a plurality of joints of five inch diameter tubing. Guide tubes 13, 15 are connected together by a plurality of partitions 17 which are preferably bolted to guide tubes 13, 15. As shown in FIGS. 5–7, partitions 17 are about 100 feet apart. As shown in FIGS. 1 and 2, partitions 17 have outer edges or webs 18 that extend out to the bore of conductor 11, thereby dividing conductor 11 into two halves. Webs 18 have an outer dimension that is transverse to longitudinal axis 22 and which is approximately equal to the inner diameter of conductor 11. Each partition 17 comprises two symmetrically formed, semi-cylindrical sections 20 facing in opposite directions. The longitudinal axes of sections 20 and guide tubes 13, 15 are located 90 degrees apart from each other relative to axis 22 of conductor 11.

Referring to FIG. 5, joints of guide tubes 13, 15 are secured to an elevator 24 and lowered into conductor 11. Approximately every 100 feet, elevator 24 stops lowering the guide tubes so that a partition 17 may be fastened to them. Elevator 24 resumes lowering the assembly into conductor 11 and repeats the sequence until the first depth of well 12 is reached by guide tubes 13, 15. Slips (not shown) are used to support guide tubes 13, 15 in conductor 11 when additional joints are secured to elevator 24.

When the lower end of guidance system 14 has a reached the desired depth, a starter head 51 (FIG. 1) is landed on its downward-facing shoulder 51*a* at the upper rim of conductor 11. A set of slips 53 secures starter head 51 to conductor 11. A plurality of bolts 55 threadingly engage holes 57 which extend upward into a lower end of starter head 51. Bolts 55 extend through an outer slip ring 59 which engages an inner slips ring 61 on conductor 11. Starter head 51 and a lock ring 63 compress an annular seal 65 against conductor 11.

Figure 4:
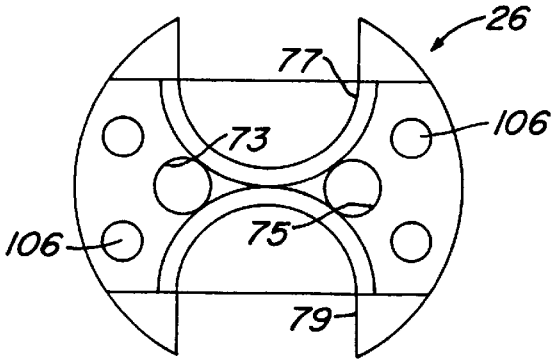
FIG. 4 is a top view of a lower mounting plate of the guidance system of FIG. 1.

After starter head 51 is installed, slips (not shown) are used to support guidance system 14 while elevator 24 is removed. A lower plate 26 (FIG. 4) is placed over the upper ends of guide tubes 13, 15 in holes 73, 75, respectively. As shown in FIG. 1, holes 73, 75 have inner diameters which are slightly larger than the outer diameters of guide tubes 13, 15. Elevator 24 then re-engages and lifts guide tubes 13, 15 to remove the slips which support the guide tubes. Lower plate 26, which has a downward-facing shoulder 26*a*, is then landed on an upward facing shoulder 51*b* on starter head 51. Lower plate 26 is spaced below an upper rim of starter head 51.

Once lower plate 26 is landed on starter head 51, a collar 32 is rigidly secured to the upper end of each guide tube 13, 15. Collars 32 have internal threads which engage external threads on guide tubes 13, 15. Elevator 24 is lowered so that shoulders 32*a* on collars 32 land on shoulders 26*b* on lower plate 26. The weight of guidance system 14 is now supported by lower plate 26. A pair of large diameter holes 77, 79 are formed in lower plate 26 and extend to the perimeter of lower plate 26. The longitudinal axes of holes 77, 79 and guide tubes 13, 15 are located 90 degrees apart from each other relative to axis 22.

Figure 3:
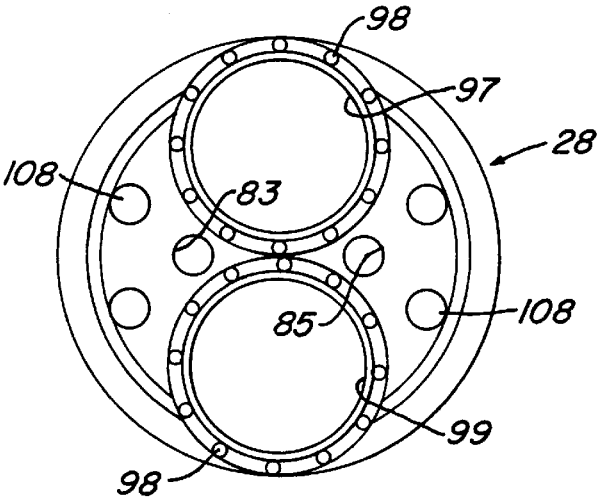
FIG. 3 is a top view of an upper mounting plate of the guidance system of FIG. 1.

Referring to FIGS. 1 and 3, an upper plate 28 is placed on top of lower plate 26. Upper plate 28 is larger in diameter than lower plate 26 and has shoulders 28*a* which land on shoulder 51*c* of starter head 51. Upper plate 28 is secured to starter head 51 with a set of latches 87. Latches 87 extend through holes 89 in starter head 51 and engage a recess 91 in the outer diameter of upper plate 28. Upper plate 28 also has holes 83, 85 which receive the upper ends of guide tubes 13, 15, respectively. Holes 83, 85 are counterbored into upper plate 28 from a lower side, and are coaxial with holes 73, 75 of lower plate 26. Collars 32 extend into the counterbores and may bump against the inner diameters of holes 83, 85 to limit the upward movement of guide tubes 13, 15. The upper portions of holes 83, 85 are smaller in diameter than collars 32. Upper plate 28 has a pair of large diameter holes 97, 99 which have the same diameter and are coaxial with holes 77, 79 in lower plate 26. Upper plate 28 also has a plurality of bolt holes 98 which surround each hole 97, 99 for securing wellhead housings (not shown). Finally, each plate 26, 28 contains coaxial through-holes 106, 108, respectively, which permit mud circulation while in use.

After guidance system 14 is installed, a string of drill pipe 25 (FIG. 6) is run through holes 97, 77. Drill pipe 25 is used to drill a first smaller diameter well from the lower end of the bore of well 12 containing conductor 11 to a desired depth. Circulation will be up conductor 11 while holes 99, 79 are plugged off. Referring to FIG. 7, a first string of casing 29 is run through holes 97, 99, down conductor 11, and through the new well bore before it is cemented in place. Casing 29 is located on one side of guide tubes 13, 15 and partitions 17.

Figure 8:
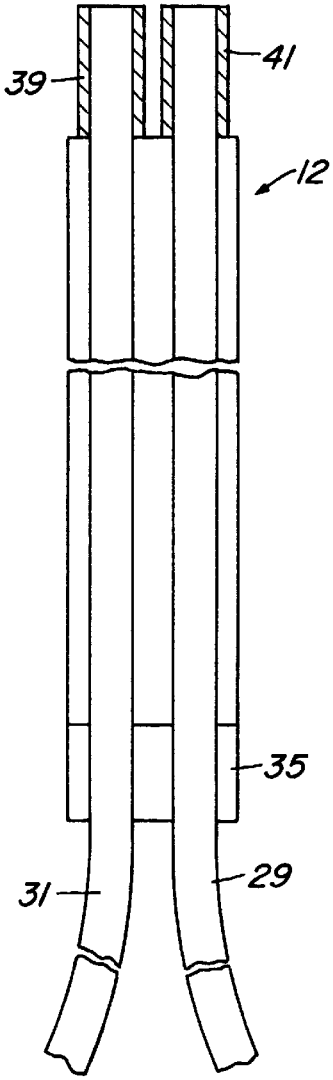
FIG. 8 is a schematic drawing of two completed wells in a single conductor after the guidance system has been removed.

Repeating the sequence, drill pipe 25 is lowered through holes 99, 79, and down the other side of guide tubes 13, 15 and partitions 17 to drill a second well bore while holes 97, 77 are plugged off. Drill pipe 25 is removed and a second string of casing 31 is cemented in its place (FIG. 8). After both strings of casing 29, 31 are in place, the interior of the lower end of conductor 11 is plugged off by pumping cement from pump 33 (FIG. 7) down one of guide tubes 13, 15 to form a cement plug 35. Cement plug 35 is located at the bottom of conductor 11. When the wells are complete, casing strings 29, 31 extend upward to the surface, and wellhead housings 39, 41 are bolted to upper plate 28 and register with casings 31, 29, respectively. The guidance assembly comprising guide tubes 13, 15 and partitions 17 remain in conductor 11.

The invention has several advantages. The invention provides a guidance system for sequentially guiding a drill string to drill two wells in a single conductor bore. The guidance system separates the casings for the two wells during their completion. The invention also provides a plate system for supporting the guidance system at the top of the conductor.

While the invention has been shown in only one of its forms, it should be apparent to those skilled in the art that it is not so limited, but is susceptible to various changes without departing from the scope of the invention.

We claim:

1. An apparatus for creating two wells in a single conductor, the apparatus comprising in combination:

a guide assembly having at least one guide tube and a longitudinal axis;

the guide assembly having a plurality of partitions secured to the guide tube, the partitions being spaced apart from each other along the longitudinal axis for dividing the conductor into two halves;

a tubular member adapted to be secured to an upper end of the conductor;

a landing support which lands on the tubular member; and wherein the landing support supports the guide tube and also is adapted to support a wellhead.

2. The apparatus of claim 1 wherein the landing support comprises a lower plate which supports the guide tube and an upper plate spaced above the lower plate for supporting the wellhead.

3. The apparatus of claim 2 wherein the upper plate is supported on an upper shoulder of the tubular member for supporting the wellhead, and the lower plate is supported on a lower shoulder of the tubular member for supporting the guide tube.

4. The apparatus of claim 2 wherein the lower plate and the upper plate each include a coaxial bore into which the guide tube extends.

5. The apparatus of claim 2 wherein the upper plate lands within an inner diameter of the tubular member.

6. The apparatus of claim 2, further comprising a latch for securing the upper plate to the tubular member.

7. The apparatus of claim 2 wherein the upper plate and the lower plate each have coaxial holes extending therethrough which are adapted to receive a well casing for each of the wells.

8. The apparatus of claim 2 wherein the lower plate has a bore and wherein the apparatus further comprises a collar secured to an upper end of the guide tube, the collar having an outer diameter which is greater than an outer diameter of the guide tube and larger than a diameter of the bore of the lower plate for supporting the guide tube on the lower plate.

9. The apparatus of claim 1, further comprising a slips and a seal on the tubular housing which are adapted to grip an outer diameter of the conductor.

10. A pair of wells in a single conductor, comprising:

a guide assembly having a longitudinal axis and a pair of parallel guide tubes;

the guide assembly having a plurality of partitions secured to the guide tubes, the partitions being spaced apart from each other along the longitudinal axis to divide the conductor into two halves;

a tubular member secured to an upper end of the conductor;

an upper plate landed on the tubular member;

a lower plate landed on the tubular member below the upper plate, the lower plate supporting the guide tubes;

a casing for each of the wells within each half of the conductor; and a pair of wellheads mounted to the upper plate wherein one of the wellheads supports each of the casings.

11. The wells of claim 10 wherein the upper plate has a pair of counterbores into which upper ends of the guide tubes extend.

12. The wells of claim 10 wherein the upper plate lands on an upper shoulder within an inner diameter of the tubular member and the lower plate lands on a lower shoulder within an inner diameter of the tubular member.

13. The wells of claim 10 further comprising a latch for securing the upper plate to the tubular member.

14. The wells of claim 10 wherein the upper plate and the lower plate each have coaxial holes which accommodate the casings.

15. The wells of claim 10 wherein the lower plate has a pair of bores and wherein the pair of wells further comprises a collar secured to an upper end of each of the guide tubes, each of the collars having an outer diameter which is greater than an outer diameter of the guide tubes and larger than a diameter of the bores of the lower plate for supporting the guide tubes in the lower plate.

16. The wells of claim 10, further comprising a slips and a seal on the tubular housing which grip an outer diameter of the conductor.

17. An apparatus for creating two wells in a single conductor, the apparatus comprising in combination:

a guide assembly having a pair of parallel guide tubes and a longitudinal axis;

the guide assembly having a plurality of partitions secured to the guide tubes, the partitions being spaced apart from each other along the longitudinal axis for dividing the conductor into two halves;

a tubular member having an inner diameter and upper and lower shoulders, the tubular member adapted to be secured to an upper end of the conductor;

a slips and a seal on the tubular member which are adapted to engage an outer diameter of the conductor;

an upper plate landed on the upper shoulder of the tubular member, the upper plate having a pair of counterbores for accommodating the guide tubes;

a latch for securing the upper plate to the tubular member;

a lower plate landed on the lower shoulder within the tubular member below the upper plate, the lower plate having a pair of bores which receive the guide tubes;

a collar secured to an upper end of each of the guide tubes, the collars having an outer diameter which is greater than an outer diameter of the guide tubes and larger than a diameter of the bores of the lower plate for supporting the guide tubes in the lower plate; and wherein the upper plate and the lower plate each have coaxial holes for accommodating a pair of well casings.

18. A method for creating two wells in a primary bore, the method comprising:

a) installing a conductor in the primary bore;

b) providing a pair of guide tubes, each guide tube having a longitudinal axis and an upper end;

c) securing the guide tubes to each other with a plurality of partitions spaced along the longitudinal axes of the guide tubes, the guide tubes being parallel to and spaced apart from each other;

d) lowering the guide tubes into the conductor with the partitions installed on the guide tubes, the partitions and the guide tubes dividing the conductor into two halves;

e) securing a tubular member to an upper end of the conductor;

f) landing a landing support in the tubular member, the landing support having a pair of holes;

g) landing upper end portions of the guide tubes on the landing support so that the guide tubes are supported in the conductor;

h) running a drill string through one of the holes of the landing support and down one of the halves of the conductor and drilling a first well below the conductor to a desired depth;

i) removing the drill string, and lowering casing through the same half of the conductor in the first well and cementing the casing in place; and j) repeating steps (h) and (i) with the drill string in the other half of the conductor to form a second well.

19. The method of claim 18, wherein after step (j) the method further comprises installing two wellheads on the landing support and supporting the casings.

* * * * *